US005335156A

United States Patent [19]

Caferro

[11] Patent Number: 5,335,156

[45] Date of Patent: Aug. 2, 1994

[54] FLEXIBLE CANTILEVERED PARABOLIC LIGHTING BAFFLE

[75] Inventor: Ronald N. Caferro, Spokane, Wash.

[73] Assignee: Ecolite Manufacturing Company, Ltd., Spokane, Wash.

[21] Appl. No.: 62,787

[22] Filed: May 14, 1993

[51] Int. Cl.[5] ..... F21V 7/00

[52] U.S. Cl. ..... 362/291; 362/325; 362/342; 362/406

[58] Field of Search ..... 362/290, 291, 342, 354, 362/325, 452, 405, 406

[56] References Cited

U.S. PATENT DOCUMENTS 4,429,354 1/1984 Garnett ..... 362/342
5,181,777 1/1993 Segill et al. ..... 362/405

FOREIGN PATENT DOCUMENTS 258413 11/1967 Fed. Rep. of Germany ..... 362/342

*Primary Examiner*—James C. Yeung
*Attorney, Agent, or Firm*—Wells, St. John, Roberts, Gregory & Matkin

[57] ABSTRACT

A flexible cantilevered lighting baffle includes a first flexible member including a top edge from which is removably suspended a second flexible member and light baffle elements mounted thereon. The first member may be attached by conventional fasteners to a ceiling structure with a top edge exposed to receive connectors on the second member. Connectors in the form of inverted "U" shaped tabs on the second member are releasably received over the top edge of the first member. Light baffle elements are mounted cantilever style to the second member, as is a light seal. The baffle elements are cantilevered on one side of the second member. The light seal is provided on the opposite side to compress against the first member and prevent escape of light between the first and second members when mounted together.

13 Claims, 5 Drawing Sheets

FLEXIBLE CANTILEVERED PARABOLIC LIGHTING BAFFLE

TECHNICAL FIELD

The present invention relates to lighting baffles and more particularly to a lighting baffle that may be applied to curved ceiling surfaces.

BACKGROUND OF THE INVENTION

Lighting baffles are typically provided in rectangular grids for placement in rectilinear arrays or as single units in ceiling structures. Difficulties are encountered when such baffles are to be placed in areas that are not rectangular. Modern architectural practice, however, often includes wall and ceiling areas that are curved. It therefore becomes desirable to provide lighting baffles that will follow a curvilinear surface.

In the past, baffles have been specially fabricated according to architectural plans. Such baffles, since special efforts in manufacturing are required, are extremely expensive. Further, baffle arrangements specially manufactured according to architectural drawings often do not fit the actual structure. This is often due at least in part to the difficulty in building such the ceiling structure precisely according to the plans. The baffle units may be manufactured to precise measurements. However, otherwise allowable deviations by the carpenters from the measurements on the plans result in poorly fitting baffle units, if the pre-manufactured, special order baffle units can be made to fit at all.

A need has therefore remained for a baffle unit that can be fitted on site to accommodate the actual "as-built" ceiling structures to assure proper fit. This need until advent of the present invention has not been filled.

BRIEF DESCRIPTION OF THE DRAWINGS

A preferred embodiment of the invention is described below with reference to the accompanying drawings, which are briefly described below.

DETAILED DESCRIPTION OF THE PREFERRED EMBODIMENTS

Figure 1:
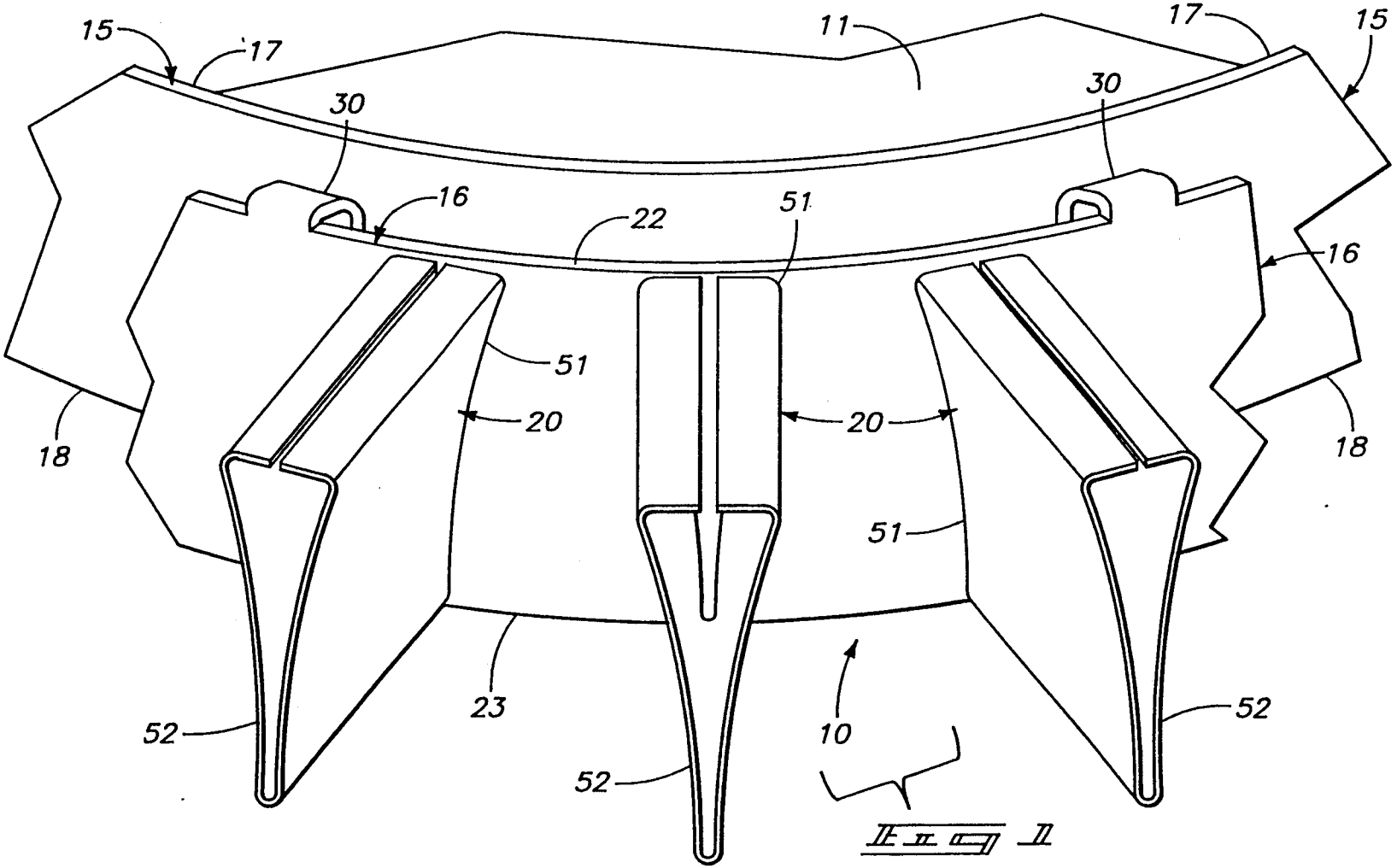
FIG. 1 is an exploded perspective view of the present baffle prior to being mounted to a ceiling structure.
Figure 2:
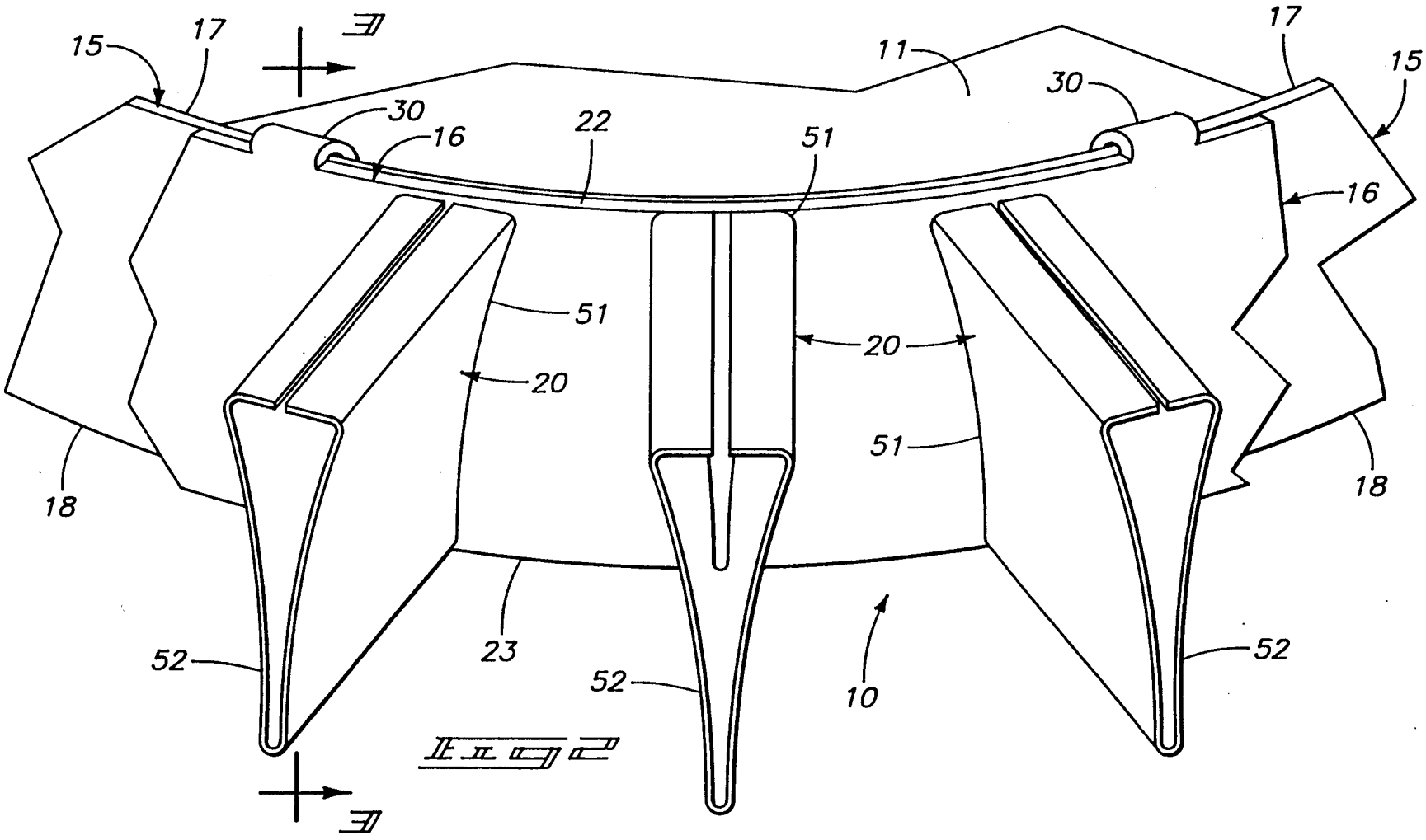
FIG. 2 is a perspective view of the present baffle mounted to the ceiling structure.
Figure 4:
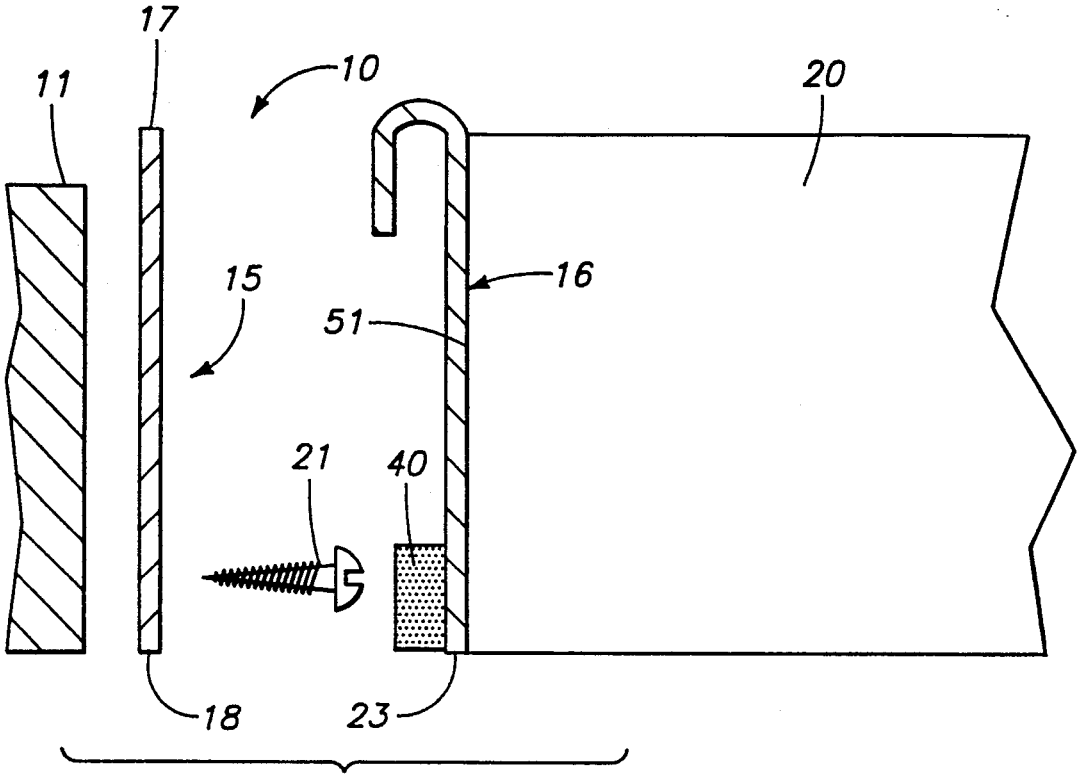
FIG. 4 is a view similar to FIG. 3 only showing the components prior to assembly.
Figure 3:
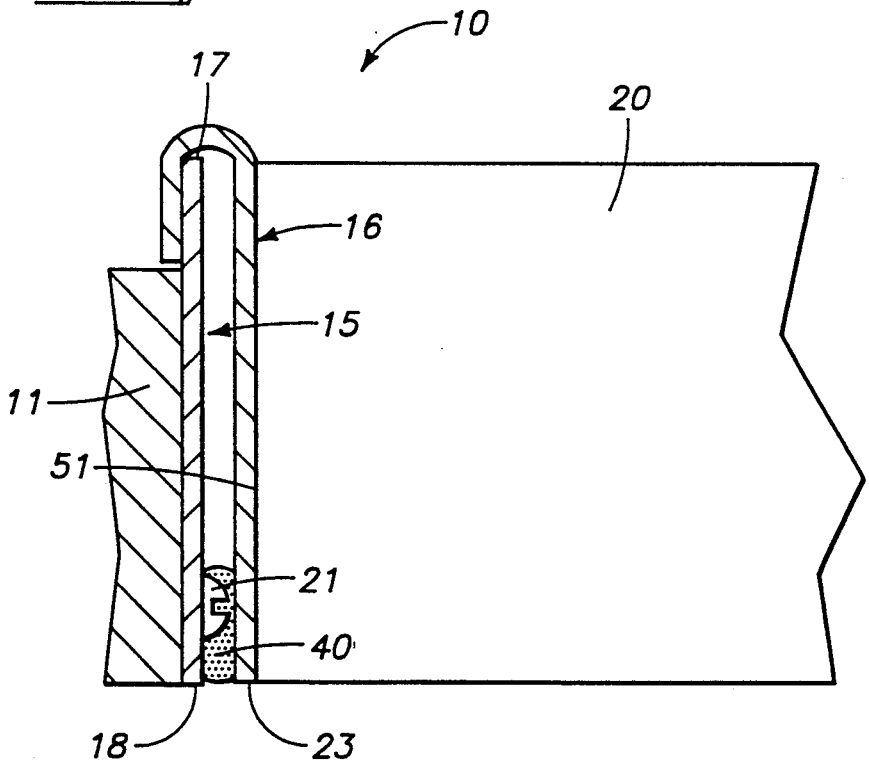
FIG. 3 is a sectioned view taken substantially along line 3—3 in FIG. 2.

This disclosure of the invention is submitted in furtherance of the constitutional purposes of the U.S. Patent Laws "to promote the progress of science and useful arts" (Article 1, Section 8).

A preferred example of the present invention is shown by the drawings and is generally designated therein by the reference numeral 10. The present baffle 10 is intended for use in ceiling structures 11 where curvilinear surfaces are present. Portions of such a ceiling structure are shown in the drawings. The shape and materials of the ceiling structure may vary, but will typically be found near the juncture of ceilings and walls.

The present baffle arrangement includes first and second flexible members 15, 16 that are preferably formed of thin, flexible metal strip material. Aluminum has been found to include sufficient flexibility for application to curved surfaces, and includes preferred light reflective properties.

The first member 15 is elongated, including longitudinal top and bottom side edges 17, 18. The width dimension of the member 15 may vary with application needs, but will typically be similar to the corresponding width dimension of the second member and attached baffle elements 20 (described in greater detail below).

The first member 15 may be easily attached to an upright surface of a ceiling structure by way of common screw 21 or nail type fasteners. Depending upon the thickness of the strip material, appropriate holes (not shown) may be provided to receive the fasteners.

Care is taken during installation of the first member 15 that the top edge 17 is exposed upwardly of the structure, along with portions of the adjacent side surfaces of the member 15. Member 15 may be provided in any appropriate length, according to the corresponding length of the ceiling structure intended to receive the lighting baffle unit 10.

The second member 16, like first member 15 is formed of flexible strip material such as aluminum sheet or strip stock, in a thickness dimension that will permit flexure along the member length. Second member 16 includes top and bottom edges 22, 23 that are separated by the member width dimension which is approximately equal to the corresponding width of the first member 15.

Connectors 30 are provided, generally to releasably join the first and second members together. It is preferred that the connectors be provided on the second member along the top edge 22 thereof. This arrangement is preferable because the connectors will then be removable from the ceiling structure along with the second member 16 for easy access in case connector replacement or repair becomes necessary.

In a first preferred form, the connectors 30 are provided along the top edge 22 and are integral with the second member 16. The connectors 30 are formed of tabs that are bent into an inverted "U" shape to receive the top edge 17 of the first member 15 to thereby suspend the second member 16 from the first member 15.

Other types of connectors, including separately manufactured clips (not shown) may also be used, preferably mounted to the second member 16 adjacent the top edge 22 thereof. Such clips may be attached to the second member 16 by common fasteners such as rivets.

A light seal in the form of an elongated soft foam pad 40 is mounted in a preferred form to the second member 16 adjacent the bottom edge 23 thereof. The seal is provided on the same side as the connectors 30 and is intended to compress against the first member 15 when the two members are connected. Pad 40 may be attached to the second member by means of conventional adhesives.

The seal pad 40 is useful to block passage of light (direct or reflected) through the space between the two members 15, 16. The foam material may be selected from a variety of appropriate compressible synthetic resin foam materials commonly available on the market.

Figure 5:
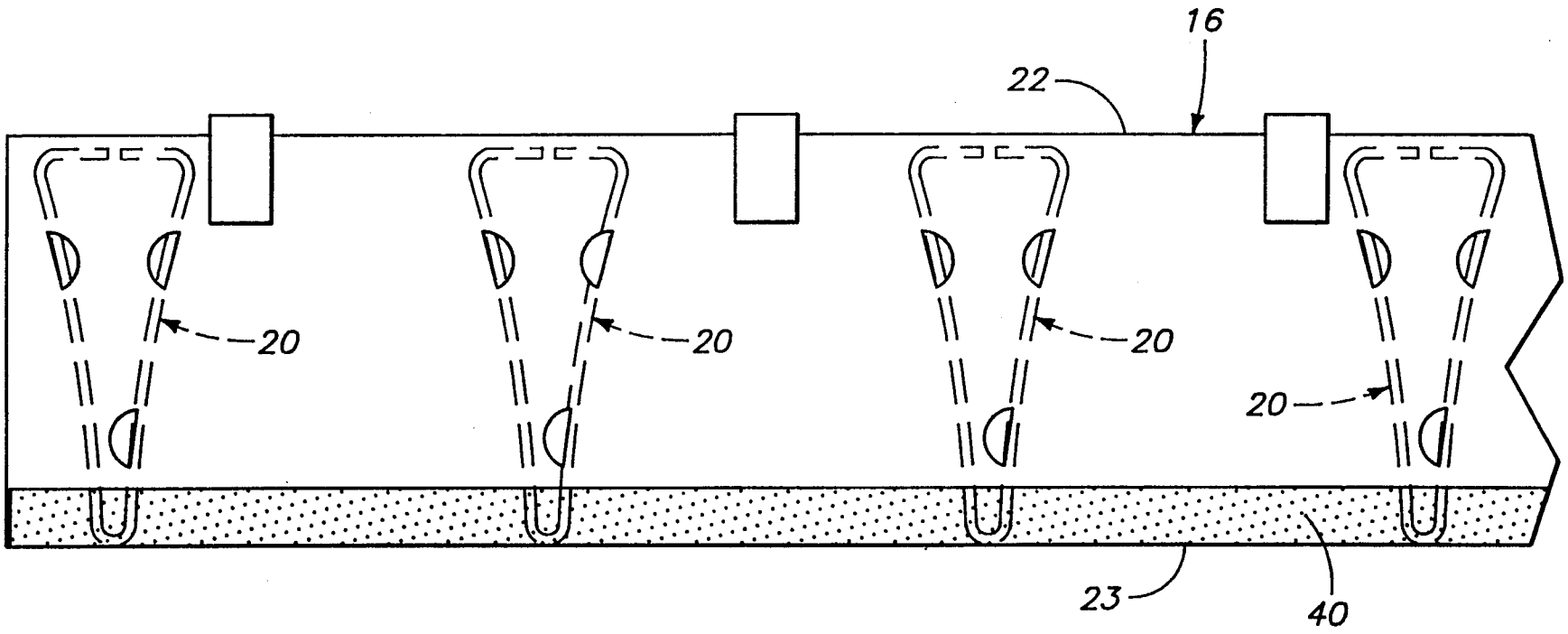
FIG. 5 is a back side view of a baffle unit.

A plurality of reflective baffle elements 20 are provided, with inward ends 51 mounted to the second member 16 and extending therefrom in cantilevered fashion to free ends 52. The elements 20 are thus supported only by the second member 16. They may be secured to the second member by way of conventional fasteners such as the integral tabs shown in FIG. 5. With the free ends 52 unsupported, the elements will conform at their inward ends 51 to whatever desired curvature is required.

Elements 50 will preferably be mounted parallel to one another and, in most cases, will project equal distances from the second member 16 to the free ends 52. Their lengths may vary according to dimensional requirements of the ceiling structure.

It is preferred that the light baffle elements 50 be provided in the form of standard parabolic light grid louvers. The baffle elements 50 could also be provided in other configurations, it being important only that they be cantilevered from the second member 16, and include otherwise unsupported free outward ends 52.

Figure 7:
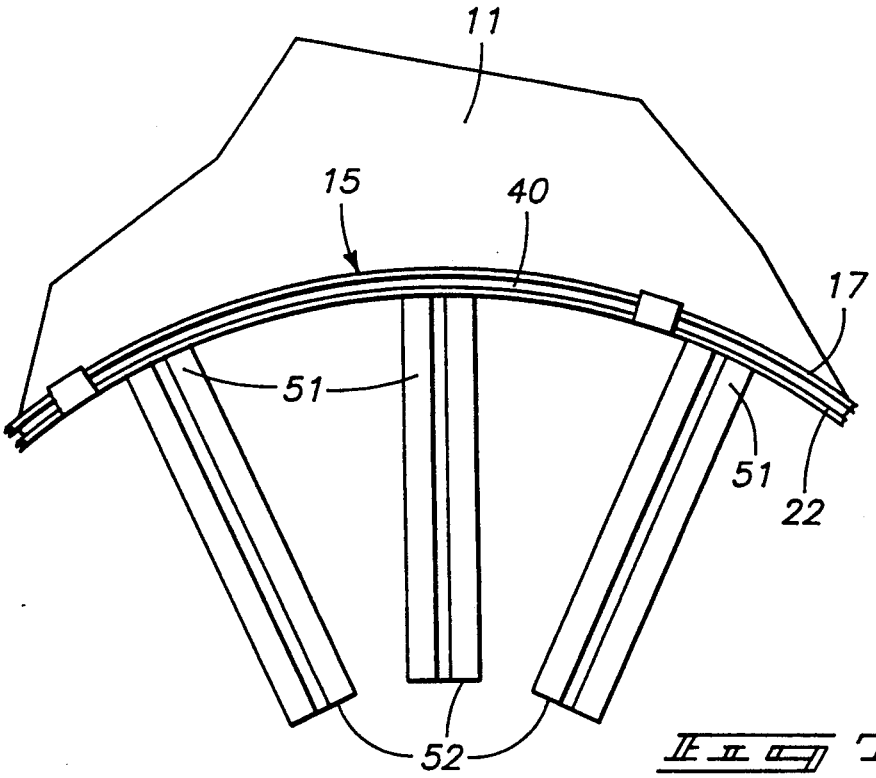
FIG. 7 is a plan view of the present baffle unit mounted to a concave ceiling structure.

It is also preferred that the light baffle elements be spaced evenly along the length of the second member 16 according to the parabolic surfaces thereon for light diffusion purposes. The spacing is also selected so the free ends do not bind against one another when the baffle unit is bent, especially in a convex configuration as shown in FIG. 7.

The baffle elements 50 are advantageously formed of aluminum, chosen for its light weight and specular properties.

Installation of the present baffle arrangement is a relatively simple task. First the first member is mounted to the ceiling structure with its top edge 17 and portions of the side surfaces exposed upwardly to receive the connectors 30.

The first member, due to its flexible nature, may be bent to conform intimately to the configuration of the ceiling structure. Conventional fasteners such as the screws shown may be used to secure the first member to the ceiling structure. The fasteners are spaced to hold the first member in the curved or otherwise formed configuration of the ceiling structure and to support the cantilevered weight of the second member and baffle elements thereon.

Next the second member 16 and baffle elements are hooked, by means of the connectors 30 over the top edge 17 of the first member 15. The seal pad 40 will compress against the first member 15, thereby effectively preventing escape of light from between the first and second members 15, 16.

Figure 6:
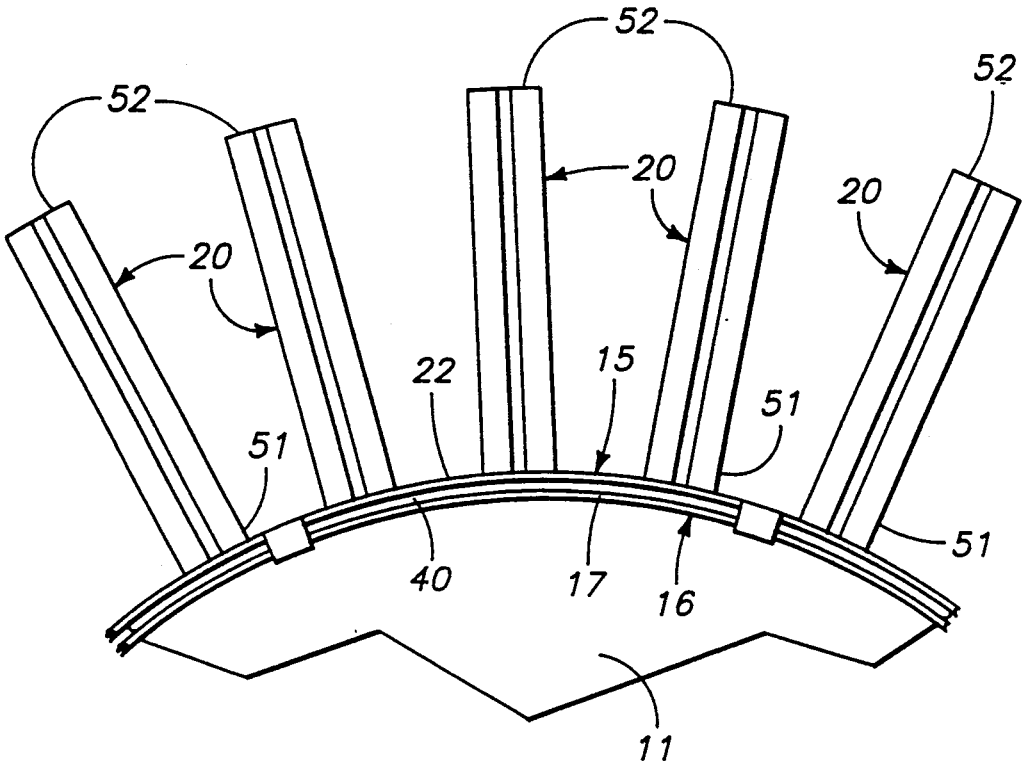
FIG. 6 is a plan view of the present baffle unit mounted to a convex ceiling structure.

The present baffle unit is now installed and conforms intimately to the configuration of the ceiling structure to which it is mounted. The baffle elements will diverge or converge (FIGS. 6, 7), depending upon the convex or concave shape taken by the second member as it bends to conform to the first member.

Removal of the second member 16 and the baffle elements mounted thereto is accomplished simply by lifting upwardly on the second member 16 and the baffle elements 50. Such action will free the connectors 30 from the first member 15 and allow removal of the second member and attached baffle elements to provide access to the lighting fixtures above.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A flexible cantilevered parabolic lighting baffle for curvilinear application to a ceiling structure, comprising:

a flexible first member adapted to be attached to a ceiling structure;

an elongated flexible second member;

wherein the second member includes longitudinal top and bottom edges, and wherein the second member includes a light seal element adjacent the bottom edge thereof;

a light baffle element mounted to the elongated flexible second member and projecting therefrom to a free end; and a connector releasably joining the first and second members together.

2. The flexible cantilevered parabolic lighting baffle for curvilinear application to a ceiling structure, as claimed by claim 1 wherein the first member is comprised of an elongated flexible strip having longitudinal top and bottom edges, and wherein the second member is also comprised of an elongated flexible strip and wherein the connector releasably joins the first and second members along the top edges thereof.

3. The flexible cantilevered parabolic lighting baffle for curvilinear application to a ceiling structure, as claimed by claim 1 wherein the connector is comprised of a tab on one of the members.

4. The flexible cantilevered parabolic lighting baffle for curvilinear application to a ceiling structure, as claimed by claim 1 wherein the connector is comprised of a tab on the second member.

5. The flexible cantilevered parabolic lighting baffle for curvilinear application to a ceiling structure, as claimed by claim 1 wherein the connector is comprised of a tab that is integral with one of the members and is bendable to conform to the other member, thereby securing the one member to the other member.

6. The flexible cantilevered parabolic lighting baffle for curvilinear application to a ceiling structure, as claimed by claim 1 wherein the first and second members are formed of flexible metal strips.

7. The flexible cantilevered parabolic lighting baffle for curvilinear application to a ceiling structure, as claimed by claim 1 wherein the light seal element is formed of a foam pad adjacent the bottom edge of the second member and positioned thereon to engage and compress against the first member.

8. The flexible cantilevered parabolic lighting baffle for curvilinear application to a ceiling structure, as claimed by claim 1 wherein the light baffle element is a parabolic reflector.

9. The flexible cantilevered parabolic lighting baffle for curvilinear application to a ceiling structure, as claimed by claim 1 wherein the first and second members are comprised of flexible aluminum sheet material.

10. A flexible cantilevered parabolic lighting baffle for curvilinear application to a ceiling structure, comprising:

a flexible first member having a top and a bottom edge and being adapted to be attached to a ceiling structure;

an elongated flexible second member having a top and a bottom edge;

wherein the second member includes a light seal element formed of a foam pad adjacent the bottom edge thereof and positioned thereon to engage and compress against the first member adjacent the bottom edge thereof;

a light baffle element mounted to the elongated flexible second member between the top and bottom edges thereof and projecting therefrom to a free end; and a connector on the flexible second member adjacent the top edge thereof for releasably joining the first and second members together at the top edges thereof.

11. The flexible cantilevered parabolic lighting baffle for curvilinear application to a ceiling structure, as claimed by claim 10 wherein the second member is formed of flexible aluminum sheet material.

12. The flexible cantilevered parabolic lighting baffle for curvilinear application to a ceiling structure, as claimed by claim 10 wherein a connector is integral with the flexible second member.

13. A flexible cantilevered parabolic lighting baffle for curvilinear application to a ceiling structure, comprising:

A flexible first member having a top and a bottom edge and being adapted to the attached to a ceiling structure;

an elongated flexible second member formed of flexible sheet material and having a top and a bottom edge;

an elongated parabolic light reflector element including an inward and an outward end, the inward end being mounted to the elongated flexible second member between the top and bottom edges thereof and projecting therefrom to the outward end, the outward end being unsupported;

a connector on the flexible second member adjacent the top edge thereof for releasably joining the first and second members together at the top edges thereof; and a light seal on one of the members adjacent the bottom edge thereof and positioned thereon to engage the other member adjacent the bottom edge thereof to prevent escape of light from between the two members.

* * * * *